US006162149A

United States Patent [19]

Scatterday et al.

[11] Patent Number: 6,162,149

[45] **Date of Patent: *Dec. 19, 2000**

[54] HAND EXERCISING DEVICE

[76] Inventors: Mark A. Scatterday, 11607 E. Estrella Ave., Scottsdale, Ariz. 85259-5009; Andrew O. Reichlin, 6010 E. Via Estrella, Paradise Valley, Ariz. 85253

[ * ] Notice: This patent issued on a continued prosecution application filed under 37 CFR 1.53(d), and is subject to the twenty year patent term provisions of 35 U.S.C. 154(a)(2).

[21] Appl. No.: 09/005,981

[22] Filed: Jan. 13, 1998

[51] Int. Cl.[7] ..... A63B 21/02

[52] U.S. Cl. ..... 482/49; 482/44

[58] Field of Search ..... 482/44, 49, 50, 482/20, 22, 148, 121; 273/58 F, 58 H; 446/267, 369

[56] References Cited

U.S. PATENT DOCUMENTS

| | | | |
|---|---|---|---|
| 3,601,923 | 8/1971 | Rosenberg | 46/151 |
| 3,977,121 | 8/1976 | Goldfarb et al. | 46/151 |
| 5,716,303 | 2/1998 | Scatterday | 482/49 |
| 5,890,999 | 4/1999 | Kildani . | |

*Primary Examiner*—Stephen R. Crow
*Attorney, Agent, or Firm*—Knobbe, Martens, Olson & Bear, LLP

[57] ABSTRACT

The invention is a resilient exercise grip that has a non-resilient core with a doughy consistency surrounded by an elastic covering. The core consists of a powdery substance, a liquid, a preservative and also contains low-density beads to create a lighter grip. The outer covering may consist of a single thick layer, or a number of thin layers. The resiliency of the grip enables a user to deform the grip and thereby change its shape which quickly and substantially returns to its pre-deformed state.

12 Claims, 2 Drawing Sheets

HAND EXERCISING DEVICE

FIELD OF THE INVENTION

This invention is in the field of exercising equipment and more particularly is directed to a device to be repeatedly squeezed by a user's hand.

BACKGROUND OF THE INVENTION

Small, squeezable hand exercise devices are frequently used to strengthen one's grip, relieve stress, or provide amusement. One type of such device includes a balloon-like covering enclosing a deformable filler material that provides resistance to squeezing. Previous devices of the type provide varying tactile sensations. The filler material in a device disclosed in U.S. Pat. No. 3,601,923 (Rosenberg) employs a mixture of starch and a saturated saline solution. This mixture provides interesting physical characteristics for an amusement device. The deformed device will apparently return to its undeformed state when not being squeezed, but at a rate that is slow for an exercise device. Also, a comfortable sized hand grip containing such a filler is rather heavy. Other prior art (e.g., U.S. Pat. No. 5,350,342 (Scatterday)) teaches the use of dry filler materials such as sand, oatmeal, beans, or millet with a dry lubricant. The particles shift during compression and provide the user with a different sensation than that of the Rosenberg patent. The filler material is not resilient, and the device does not return to its pre-compression shape when released.

SUMMARY OF THE INVENTION

The present invention provides an improved grip that the user squeezes in one hand and has an elastic covering enclosing a filler material. The grip provides a resilient characteristic such that when the user stops compressing the grip, it quickly returns to at least about 90% the shape it had prior to compression. To achieve this resilient characteristic, the grip comprises a core containing a mass of a doughy consistency contained in an elastic covering. The mass includes a powdery substance, such as starch, a liquid, such as water, and a preservative, such as salt. Beads, such as expanded rigid polystyrene plastic, such as that sold under the trademark STYROFOAM, having a lower density than the powder/liquid/preservative mixture, decrease the weight of the core. The combination provides an excellent exercise device that has a desired "feel" and is durable.

DETAILED DESCRIPTION OF THE PREFERRED EMBODIMENTS

Figure 1:
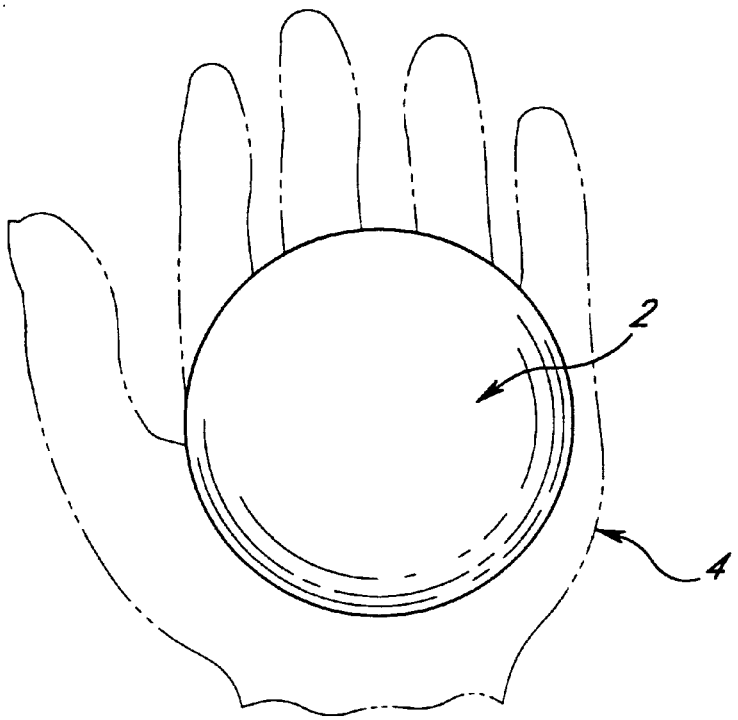
FIG. 1 is a perspective view of the device being held in a user's hand

In a non-deformed state, the grip 2 has a generally spherical shape, as shown in FIG. 1. It is sized to comfortably fit in a user's palm 4 and preferably weighs from three to five ounces. As can be seen from the cross-sectional view of FIG. 4, the grip 2 includes a core 6 that is surrounded by an elastic covering 8 such as a plurality of balloons 10, 12, 14, 16, and 18.

The core of the grip 6 is essentially non-resilient and is formed from a mixture 20 of powder, liquid, and a preservative ("the mixture") having a doughy consistency. The core 6 also contains small beads 22 which have a lower density than the mixture 20 thereby advantageously decreasing the weight of the grip 2 compared to a core comprised entirely of the mixture 20. A preferred embodiment of the contents of the mixture 20 includes starch, water, and salt, and expanded rigid polystyrene plastic, such as that sold under the trademark STYROFOAM, beads. The doughy mixture 20 is preferably made by mixing equal parts of starch, salt, and boiling water. The hot water contributes to the thorough combining of the salt and the starch. The proportions specified create a dough that is not runny but is easily squeezed into a different shape by the user's hand. The mixture 20 is mixed with the beads 22, but still retains its doughy consistency. The ratio of the volume of the mixture 20 to the beads 22 is about 1:1, but may be altered to attain the desired weight of the grip 2. The core 6 may be comprised of any materials having a similar viscosity, weight, and frictional characteristics to the mixture 20 described above.

Each of the balloons 10, 12, 14, 16, 18 is very thin and is preferably round in shape when inflated. As the core material 6 is inserted, the balloon 10 stretches to retain a spherical shape although other shapes can be used. To allow for the insertion of the core 6, each balloon includes a single hole 24. The exterior surface of balloon 18 may be textured to facilitate the grasping of the grip 2 and to improve user comfort.

To construct the grip 2, the dough like core 6 is inserted through hole 24 of the first balloon 10. The entering material 6 stretches the balloon in a manner somewhat similar to when water is forced into a balloon to make a water balloon. Sufficient material is inserted to create a round core 6 that has a diameter of approximately two and one-quarter inches. The grip can be made larger or smaller than that, but that size is convenient for most people. Once the first balloon 10 has been filled, the single wrapped core 6 is then inserted through hole 24 of the second balloon 12 thereby causing it to stretch to a similar diameter. During the latter insertion process, the hole 24 in the balloon 10 is located so that it is spaced approximately ninety to one-hundred-eighty degrees apart from the hole 24 in the encircling balloon 12. This procedure is then repeated with the remaining balloons 14 and 16 until the grip's core 6 is enveloped by a plurality of balloons, preferably four. Once the core 6 has been inserted within the final balloon 16, glue is placed around the perimeter of hole 24 of balloon 16 to fix the surrounding of the hole 24 to the underlying balloon 14.

It should be noted that in receiving the core 6, each succeeding balloon is stretched, thereby causing a constant inward force to be exerted on the core by the balloons. In this manner, the balloons urge the grip to assume the shape the balloons originally had.

In an alternate mode of manufacture, the core material 6 is first placed within a balloon 10. The enveloped core is then dipped into molten rubber to thereby form an outer resilient layer that does not have an opening.

In another alternate mode of manufacture, the core can be received within a single, thick balloon (not shown) that is then plugged to prevent the escape of the core material. The covering is resilient and is round in an undeformed state.

The core 6 made of the mixture 20 and beads 22 provides a device with unique characteristics and capabilities. When the pliable grip 2 is initially deformed by a user's hand with a moderate amount of squeezing force, the user must overcome the core's resistance to deformation and cause the resilient covering to stretch. When the user ceases compressing the grip 2, the balloons readily and substantially resume a spherical, inflated shape, that is, at least about 90% of the original shape. In this manner, the grip 2 is resilient.

In FIG. 1, the grip 2 is shown prior to deformation and as such, it has a substantially spherical shape. It is being held in a user's hand 4 atop the palm portion of the hand. The user is exerting no pressure on the grip.

Figure 2:
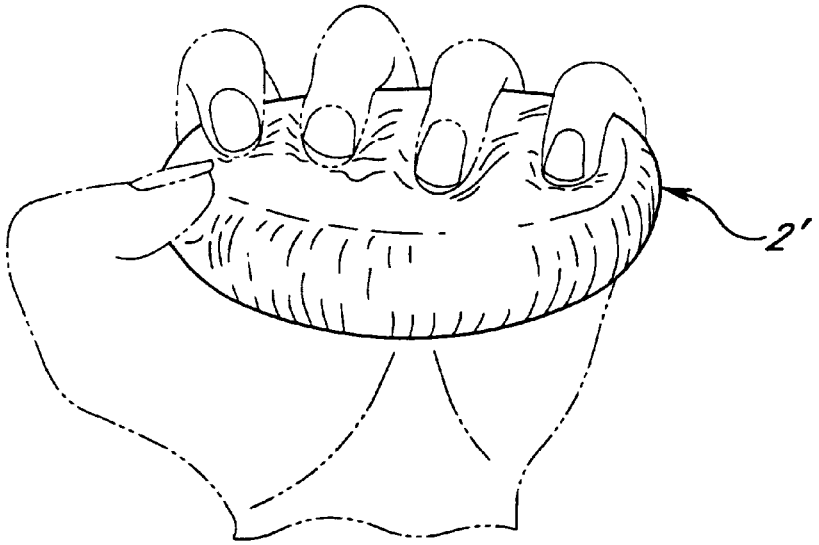
FIG. 2 is a perspective view of the device shown in FIG. 1 being squeezed by the hand.

FIG. 2 shows the grip 2 at a point when the user's fingers and palm have deformed its shape. The grip 2 has become compressed into a disc shape (labeled 2') and depressions have been formed on its surface that partially receive/surround the contacting portion of the user's fingers. At the stage shown, the user's hand 4 is still exerting a compressive pressure on the grip 2.

Figure 3:
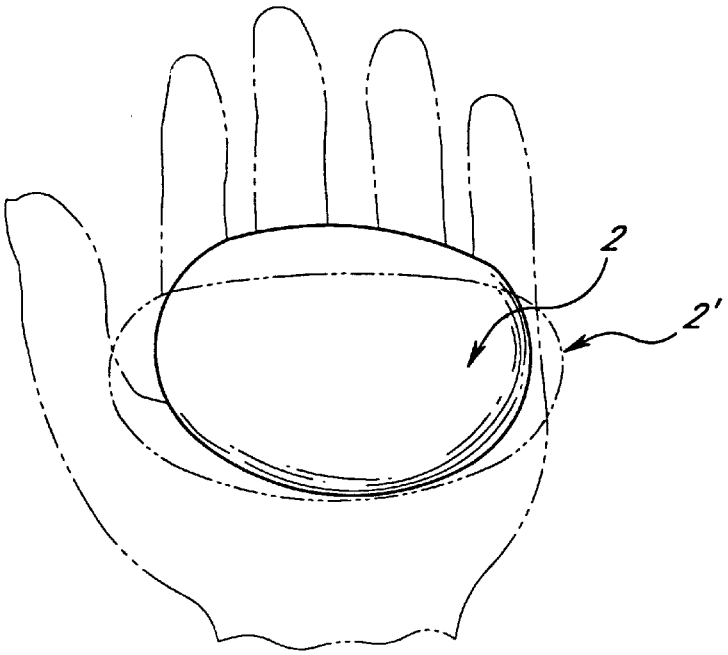
FIG. 3 is a perspective view of the device of FIG. 1 after the compression shown in FIG. 2 has ceased.

FIG. 3 shows the next stage wherein the user's hand 4 has relaxed and is no longer exerting compressive forces on the grip 2. The grip 2 has readily sprung back to most of its original shape. The phantom lines show the previously deformed shape of the grip 2'. The user can now apply compressive pressure to the grip 2 and mold it again.

Figure 4:
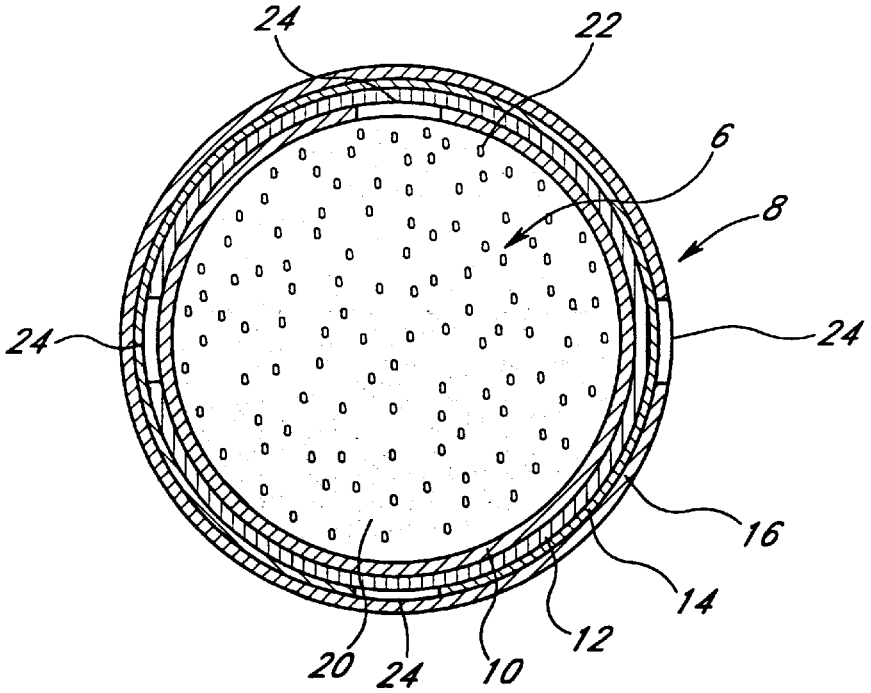
FIG. 4 is a cross-sectional view of the device shown in FIG. 1.

FIG. 4. shows a cross-sectional view of the invention with the core 6 visible with the mixture 20 and beads 22.

The embodiment disclosed herein has been discussed for the purpose of familiarizing the reader with the novel aspects of the invention. Although a preferred embodiment of the invention has been shown and described, many changes, modifications and substitutions may be made by one having ordinary skill in the art without necessarily departing from the spirit and scope of the invention as described in the following claims.

What is claimed is:

1. A resilient exercise grip comprising:

a core including a mixture of liquid and dry material forming a doughy consistency that is not runny and is not self-restoring, to its original shape when squeezed, said core further including a quantity of small lightweight beads mixed with the doughy mixture, and an elastic covering enclosing the core, wherein the volume of the core is greater than the unstretched volume of the covering so that the core fills and stretches the covering, the consistency of the core and the inward force provided by the stretched covering is such that when the grip is initially in a non-deformed shape and is then squeezed to a deformed shape, the grip readily returns to most of its original shape, upon the release of the squeezing force.

2. The grip of claim 1 wherein the mixture comprises a powdery substance, liquid, and a preservative.

3. The grip of claim 2 wherein the powdery substance is starch, the liquid is water, and the preservative is salt.

4. The grip of claim 3 wherein the mixture is one part starch, one part water, and one part salt.

5. The grip of claim 1, wherein the beads are made of expanded rigid polystyrene plastic.

6. The grip of claim 1 wherein about half of the core's volume comprises said beads.

7. The grip of claim 1 wherein about half the volume of the core comprises a powder, liquid, and preservative mixture, and about half the volume of the core comprises beads with a lower density than the mixture.

8. The grip of claim 1 wherein the covering is substantially spherical when in an inflated, non-deformed state.

9. The grip of claim 1 wherein the covering comprises a plurality of inflatable and elastic balloons.

10. The grip of claim 1 wherein the covering includes a plurality of nested balloons wherein each balloon includes an opening, and the openings of adjacent balloons are spaced from each other so that each total inward force on the core is the combined total of the individual inward forces exerted on the core by the balloons.

11. A squeezable hand device comprising a deformable core and a pliable, elastic covering enclosing the core, said core including expanded polystyrene plastic beads mixed with a moldable, filler material comprising liquid and a dry material that creates a doughy mixture that is readily deformed by squeezing, but is not runny, the strength of the elastic covering and the characteristics of the covering being such that after the device is squeezed into a deformed shape and then released, the covering will quickly restore the device to most of its original shape.

12. The device of claim 11 wherein the beads occupy about half of the core's volume.

* * * * *